US010285459B2

(12) United States Patent
Gubitosa et al.

(10) Patent No.: US 10,285,459 B2
(45) Date of Patent: May 14, 2019

(54) GARMENT AND BEDDING FOR IDENTIFYING A MEDICAL PROCEDURE SITE

(71) Applicants: David Gubitosa, Hillsborough, NJ (US); Amelia Gubitosa, Hillsborough, NJ (US)

(72) Inventors: David Gubitosa, Hillsborough, NJ (US); Amelia Gubitosa, Hillsborough, NJ (US)

( * ) Notice: Subject to any disclaimer, the term of this patent is extended or adjusted under 35 U.S.C. 154(b) by 369 days.

(21) Appl. No.: 14/857,878

(22) Filed: Sep. 18, 2015

(65) Prior Publication Data

US 2016/0081405 A1 Mar. 24, 2016

Related U.S. Application Data

(60) Provisional application No. 62/051,985, filed on Sep. 18, 2014.

(51) Int. Cl.

| | |
|---|---|
| ***A41B 9/00*** | (2006.01) |
| ***A41D 13/12*** | (2006.01) |
| ***A47G 9/02*** | (2006.01) |
| *A61G 1/01* | (2006.01) |
| *A61G 13/12* | (2006.01) |

(52) U.S. Cl.

CPC ..... *A41D 13/1236* (2013.01); *A47G 9/0238* (2013.01); *A47G 9/0246* (2013.01); *A41D 13/1281* (2013.01); *A41D 2300/50* (2013.01); *A61G 1/01* (2013.01); *A61G 13/126* (2013.01); *A61G 2205/20* (2013.01)

(58) Field of Classification Search

CPC ..... A41D 13/1209; A41D 13/1236; A41D 13/1245; A41D 27/08; A41D 13/12; A47G 9/0238; A47G 9/02; A47G 9/0246; A61B 46/00; A61B 90/94; A61B 2046/205; A61B 5/117; A61B 2090/0807; A61B 5/6804

See application file for complete search history.

(56) References Cited

U.S. PATENT DOCUMENTS

| | | | | |
|---|---|---|---|---|
| 3,852,826 | A | 12/1974 | Schindler | |
| 4,027,665 | A | 6/1977 | Scrivens | |
| 4,373,214 | A | 2/1983 | Wichman | |
| 4,947,867 | A | 8/1990 | Keeton | |
| 5,062,159 | A * | 11/1991 | Jakub | A41D 13/1236 2/105 |
| 5,655,236 | A * | 8/1997 | Murray | A47G 9/0238 5/482 |
| 6,138,278 | A * | 10/2000 | Taylor | A41D 13/1227 2/114 |
| 6,499,143 | B2 | 12/2002 | Garza | |
| 6,675,389 | B1 * | 1/2004 | Kublick | B63C 11/04 2/128 |

(Continued)

*Primary Examiner* — Shin H Kim

(74) *Attorney, Agent, or Firm* — Gearhart Law, LLC

(57) ABSTRACT

A color coded garment and color coded bedding can be used in a medical setting to identify the location of a medical procedure to take place. A medical patient would wear a specific color coded garment that identifies, through color, the location of a medical procedure to take place. The medical patient's bedding would also reflect this location using a similar color coded identification mechanism. The combination of the two (garment and bedding) provide unmistakable visual indicia that will help limit or reduce wrong site medical procedures.

5 Claims, 6 Drawing Sheets

(56) References Cited

U.S. PATENT DOCUMENTS 6,792,622 B2 * 9/2004 Graves ..... A41D 13/1245 2/114
7,205,449 B2 4/2007 Levin
7,260,852 B2 * 8/2007 Sheetz ..... A41D 7/00 2/104
7,305,716 B1 * 12/2007 Richards ..... A41D 13/1245 2/114
7,627,908 B1 12/2009 Pinckney, II
7,802,313 B2 9/2010 Czajka
7,815,123 B2 10/2010 Conner et al.
7,886,742 B2 2/2011 Haines et al.
RE42,628 E * 8/2011 Aperfine ..... A41D 3/04 2/82
8,011,371 B2 9/2011 Rotolo
D646,467 S * 10/2011 Campbell ..... D2/739
D663,103 S * 7/2012 Mims ..... D2/739
8,209,773 B2 * 7/2012 Bothwell ..... A41D 13/1245 2/104
8,302,214 B2 11/2012 McGrath
8,371,306 B2 2/2013 Haines et al.
8,438,679 B2 * 5/2013 Wootten, Jr. ..... A47G 9/0246 5/482
8,485,827 B1 7/2013 Robinson
8,646,114 B1 2/2014 Williams
8,667,627 B1 * 3/2014 O'Malley ..... A47G 9/023 5/482
8,726,416 B2 5/2014 Roblejo
D738,591 S * 9/2015 Criss ..... D2/720
9,687,032 B2 * 6/2017 McBride ..... A41D 13/1209
2002/0179094 A1 12/2002 Perlow
2003/0187458 A1 10/2003 Carlson, II
2004/0056478 A1 3/2004 Bruce
2004/0117889 A1 6/2004 Shultz et al.
2004/0237206 A1 * 12/2004 Webster ..... A47C 21/046 5/727
2005/0132493 A1 * 6/2005 Lauderman ..... A47G 9/02 5/495
2005/0183182 A1 8/2005 Keenan
2007/0033697 A1 * 2/2007 Soldwedel ..... A41B 13/00 2/80
2007/0083997 A1 * 4/2007 Piraino ..... A47C 23/067 5/727
2008/0033405 A1 2/2008 Rothman
2008/0196144 A1 8/2008 Ruiz
2008/0201856 A1 * 8/2008 Howard ..... A47C 27/001 5/690
2009/0300820 A1 * 12/2009 Cansler ..... A41D 13/1236 2/114
2010/0017938 A1 1/2010 Shultz et al.
2011/0107494 A1 5/2011 Haines
2012/0054948 A1 3/2012 McKinnon et al.
2014/0259389 A1 * 9/2014 Hillenbrand, II .... A61G 7/1026 5/81.1 HS
2015/0026882 A1 * 1/2015 Hillenbrand, II .... A61G 7/1026 5/81.1 HS
2016/0067131 A1 * 3/2016 Hillenbrand, II .... A61G 7/1026 5/81.1 HS

* cited by examiner

GARMENT AND BEDDING FOR IDENTIFYING A MEDICAL PROCEDURE SITE

CLAIM OF PRIORITY

This application claims the priority of U.S. application Ser. No. 62/051,985 filed on Sep. 18, 2014, the contents of which are fully incorporated herein by reference.

FIELD OF THE EMBODIMENTS

This invention and its embodiments relate to garments and bedding for use in medical environments, namely medical procedures including surgical procedures. In particular, the present invention and its embodiments relate to a color identification and warning system that is prominently displayed on both the patient's garments and bedding to increase situational awareness of medical facility staff and limit or prevent wrong site medical procedures.

BACKGROUND OF THE EMBODIMENTS

Wrong site surgery is generally defined as an operation or medical procedure performed on the wrong part of the body of a medical patient. Under this definition, there are a number of types of wrong site medical procedures, namely surgeries. For example, surgery performed on the incorrect side of a body of a medical patient, surgery performed on the correct side of the body of a medical patient but at the wrong site (body area), and an incorrect operation performed on the correct side and correct location of the medical patient.

It is estimated that as many as 40 wrong site surgeries occur each week in this country alone, however, there is limited information as to the exact number of such occurrences due to underreporting by doctors and hospitals. Regardless, this is a very serious matter than can have disastrous outcomes including permanent disfigurement or even the death of a medical patient.

As such, there have been numerous attempts to remedy the frequency of these occurrences, but these attempts have resulted in little to no impact on the number of such incidents. One such remedy is to have the medical patient and physician mark the site to be subjected to a medical procedure. Another potential remedy involves thorough checklist(s) with a planned "time out" that occurs before the surgery or medical procedure. In this "time out" period, the name, charts, and surgery site (amongst other variables) of the medical patient are to be reviewed. However, these checklists are often only partially performed or performed incorrectly by the medical professionals.

One major problem plaguing surgical rooms and exacerbating the number of wrong site medical procedures is the lack of a universal standard for prevention of such occurrences. Currently, different medical facilities and establishments follow similar, but not identical guidelines. Further, as mentioned above, there are often breakdowns in these processes. In some instances, time constraints result in rushed or incomplete medical patient assessments and the aforementioned "time outs." Additionally, similar medical patient names, short hand notation used by hospital staff, and the involvement of multiple individuals all contribute to the lack of cohesion that can result in a wrong site surgery or other medical procedure.

Thus, there is a need for a simple, yet effective, solution to drastically limit or prevent wrong site surgeries. Such a solution should further be cost-effective and relatively simplistic in nature in order to enable any medical facility or establishment to readily implement the changes necessary to meet these needs. The present invention and its embodiments meet and exceed these objectives.

Review of Related Technology

U.S. Pat. No. 8,371,306 pertains to a surgical drape and system/method of using a surgical drape having a fenestration to be placed over a surgical site of a medical patient. The surgical drape includes a barrier removably attached to the surgical drape and adapted for placement over a portion of the fenestration to prevent the start of the surgical procedure. Upon verification of a set of predetermined conditions, the barrier is removed by a member of the surgical staff in order to begin the surgical procedure.

U.S. Pat. No. 7,802,313 pertains to a disposable surgical gown having a neck binding that includes a visual indicator to identify the barrier protection level associated with the disposable surgical gown. In particular, the disposable surgical gown has a neck binding that is color-coded for identifying the barrier protection level associated with the disposable surgical gown for protecting against penetration of body fluids and infectious materials. Also disclosed is a disposable surgical drape having a visual indicator, such as color-coding, to identify the barrier protection level associated with the disposable surgical drape. A surgical kit includes the disposable surgical gown and/or disposable surgical drape having visual indicators, such as color-coding, to identify the barrier protection level. The surgical kit may include other items to be used in a surgical setting which may also have visual indicators, such as color-coding, to identify the barrier protection level associated with the disposable surgical gown and/or disposable surgical drape.

Various devices are known in the art. However, their structure and means of operation are substantially different from the present disclosure. The other inventions also fail to solve all the problems taught by the present disclosure. The present invention and its embodiments provide for a garment and/or bedding that is used to quickly identify the site of a medical procedure to be performed on medical patient using visual indicia. At least one embodiment of this invention is presented in the drawings below and will be described in more detail herein.

SUMMARY OF THE EMBODIMENTS

A medical site identification kit is described and taught having a garment with a color coded identification system, wherein a first color signifies a body area of the medical patient that is subject to a medical procedure and a second color signifies a body area of a medical patient that is a neutral site; at least one layer of fabric for covering a bed and employing a color coded identification system, wherein a first color signifies a body area of a medical patient that is subject to a medical procedure and a second color signifies a body area of a medical patient that a neutral site and wherein there is at least one visual indicia on the at least one layer of fabric; and wherein the position of the site subject to a medical procedure identified on the at least one color coded garment corresponds to the position of the site subject to a medical procedure identified on the at least one color coded layer of fabric.

In at least one embodiment, the neutral site color is red and the medical procedure site is green. To further reinforce the color scheme, a visual indicia is applied to the medical procedure site side of the bedding or bed covering. For example, the word "yes" may appear on the green side (side of body subject to a medical procedure) which lets a medical patient and medical professional alike know that this is unmistakably the correct side for which the medical procedure is to be performed.

The garment bears the same color pattern as the bedding which may be the same or different as the red/green color scheme described above. Further the garment may cover the head, neck, torso, arms, hands, legs, feet, or any combination thereof.

In another aspect of the present invention, there is a method of identifying a medical procedure site, the method having the steps of: identifying a location of at least one medical procedure site on a medical patient; selecting a color coded garment and a color coded bedding combination, wherein the color coded garment and the color coded bedding have a coloration pattern that identifies the location of the medical procedure site; and placing the color coded garment on the medical patient in the correct orientation and the color coded bedding on a bed in the correct orientation. The method may further comprising the step of confirming the correct orientation of the color coded garment and the color coded bedding.

In the above described methodology, the orientation of the color coded garment is confirmed by establishing the coloration pattern identifies the correct location of a medical procedure site, and the orientation of the color coded bedding is confirmed by establishing the coloration pattern identifies the correct location of a medical procedure site. Further, the color coded bedding may be confirmed to have the correct orientation by establishing the correct orientation and/or location of the visual indicia present on the bedding.

In general, the present invention succeeds in conferring the following, and others not mentioned, benefits and objectives.

It is an object of the present invention to provide a medical site identification kit that limits or prevents wrong site surgeries.

It is an object of the present invention to provide a medical site identification kit that uses an identification system that identifies the left or right side of a medical patient's body that is subject to a medical procedure.

It is an object of the present invention to provide a medical site identification kit that is cost effective for medical facilities and establishments.

It is an object of the present invention to provide a medical site identification kit that can be used for sterile procedures including surgeries.

It is an object of the present invention to provide a medical site identification kit that can identify a variety of positions relative to the medical patient's body.

It is an object of the present invention to provide a medical site identification kit that creates a universal standard for use in medical facilities and the like to unitize the prevention of medical mishaps.

It is another object of the present invention to provide a medical site identification kit that may be reusable.

DESCRIPTION OF THE PREFERRED EMBODIMENTS

Figure 1A:
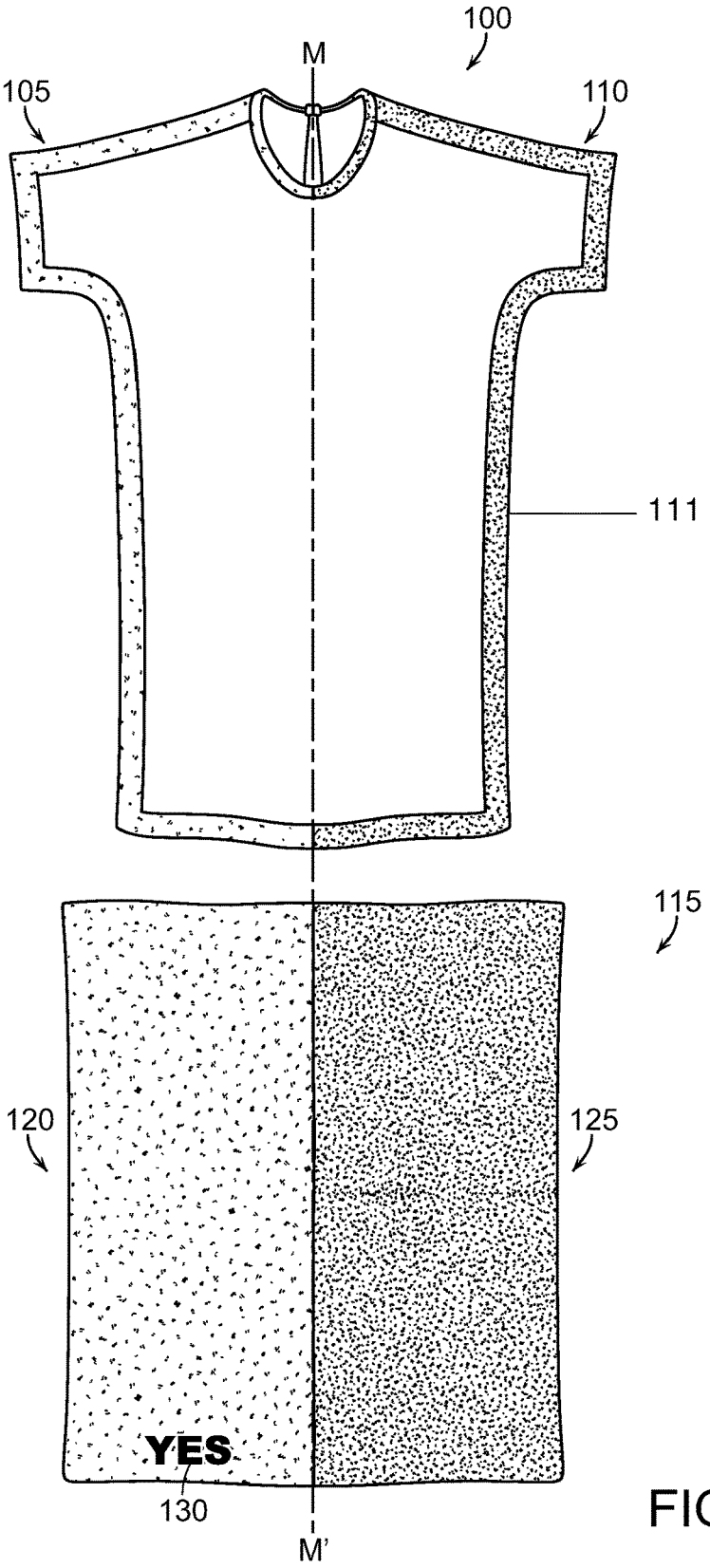
FIG. 1A is a front view of a color coded garment and bedding for a supine right side medical procedure.
Figure 1B:
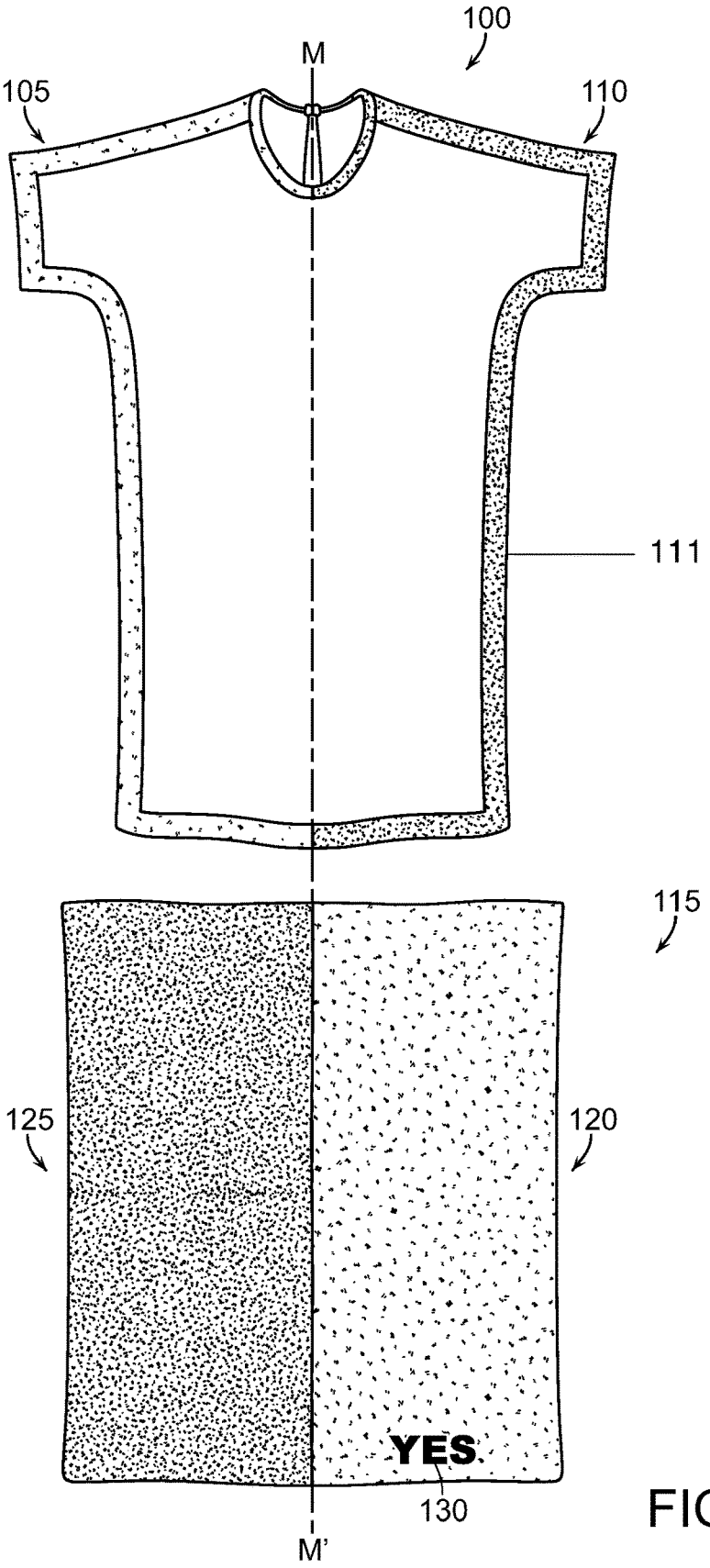
FIG. 1B is a front view of a color coded garment and bedding for a prone right side medical procedure.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Referring now to FIGS. 1A-2B, there is a garment 100 and a bed covering 115 displaying multiple color schemes and combinations of such schemes. Generally, the garment 100 as shown has a color identification system, however, other symbols, characters, words, phrases and the like may be used singularly or in any combination. In a preferred embodiment, the color identification system is used to signify the location of a medical procedure and the location of a neutral site or non-medical procedure site.

As used herein a "medical procedure site" is a location on a body, preferably mammalian, that is subject to an invasive or non-invasive medical procedure to be performed with the intent of determining, measuring, diagnosing, or treating a condition associated with a subject or medical patient.

As used herein a "neutral site" is a location on a body, preferably mammalian, that is not subject to an invasive or non-invasive medical procedure to be performed with the intent of determining, measuring, diagnosing, or treating a condition associated with a subject or medical patient.

The garment 100 may have a trim 111 that extends around a periphery of the garment 100. This trim 111 contains the color identification system which preferably has at least two colors. The two colors, a first color 105 and a second color 110 are used to determine the side of a body, either left or right, that is subject to a medical procedure. Each of the first color 105 and the second color 110 are disposed on either side of the midline (M) of the garment 100.

Typically a first color 105 is a color that signifies that side of the body is subject to a medical procedure. As such, the color used is preferably green to signify "go" or "ok" thus verifying in the affirmative the side of the body subject to a medical procedure. Typically a second color 110 is a color that signifies the side of the body that is a neutral site. As such, the color used is preferably red to signify "stop" or "danger" thus alerting any individual that the side is not subject to a medical procedure.

The garment 100 may be a standard hospital gown given to medical patients during their stay or in preparation of a medical procedure. Further, the garment 100 may be any garment employing the principles described herein and may cover any of the head, neck, facial region, torso, arms, legs, hands, feet, or any combination thereof. For example, two arm sleeves bearing the color identification system could be used with one arm sleeve having a first color 105 and the other arm sleeve having a second color 110. Thus, in some instances, the garment 100 may not be a unitary item but may comprise multiple parts that can be applied to multiple areas of the body of the medical patient simultaneously.

A bed covering or bedding 115 is used in conjunction with the garment 100 in order to complete a medical site identification system. The bed covering 115 comprises at last one layer of color coded fabric, and the color coding preferably matches that of the garment 100. The bed covering 115 may be sized to cover a particular size bed (i.e. twin, queen, etc.) or may be sized to only partially cover the bed. The bed covering 115 is preferably divided into two halves down the midline (M') of the covering. This creates a two section bed covering with one section having a first color 120 and a second section having a second color 125. The first color 120 corresponds to a side of the body that is a site subject to a medical procedure and the second color 125 corresponds to a side of the body that is a neutral site.

On the side of the bed covering 115 having a first color 120, there may be at least one visual indicia 130 disposed on the at least one layer of fabric. This visual indicia 130 may be any form of warning including characters, words, images and the like or any combination thereof. As shown, the visual indicia 130 is the word "yes" which further signifies that this is the correct side of the body for the medical procedure to be performed. Additionally, this visual indicia 130 supplies a visual indication that not only is the correct side identified, but that the bed covering 115 is oriented correctly. The visual indicia 130 must have the correct orientation to be read, viewed, etc. from the foot of the bed with the visual indicia 130 present at the foot of the bed as well (see FIG. 3).

Thus, the garment 100 and bed covering 115 shown in FIG. 1A are positioned from the point of the wearer to be positioned in a supine position. In turn, the garment 100 and bed covering 115 in FIG. 1A signify a medical procedure that is to be performed on the right side of a body. However, in FIG. 1B the bed covering 115 has an opposite orientation. The bed covering 115, as shown, has a first color 120 and visual indicia 130 on the opposite side of the midline (M') when compared to that shown in FIG. 1A. The garment 100, however, still has the same color layout as shown in FIG. 1A. Here, in FIG. 1B, the garment 100 and bed covering 115 are for a medical patient who is going to receive a medical procedure on the right side of their body but must be in a prone position in order to do so. A prone position is when a medical patient is laid face down on a medical procedure or operating table. Such a position may be used in orthopaedic procedures on the spine.

Figure 2A:
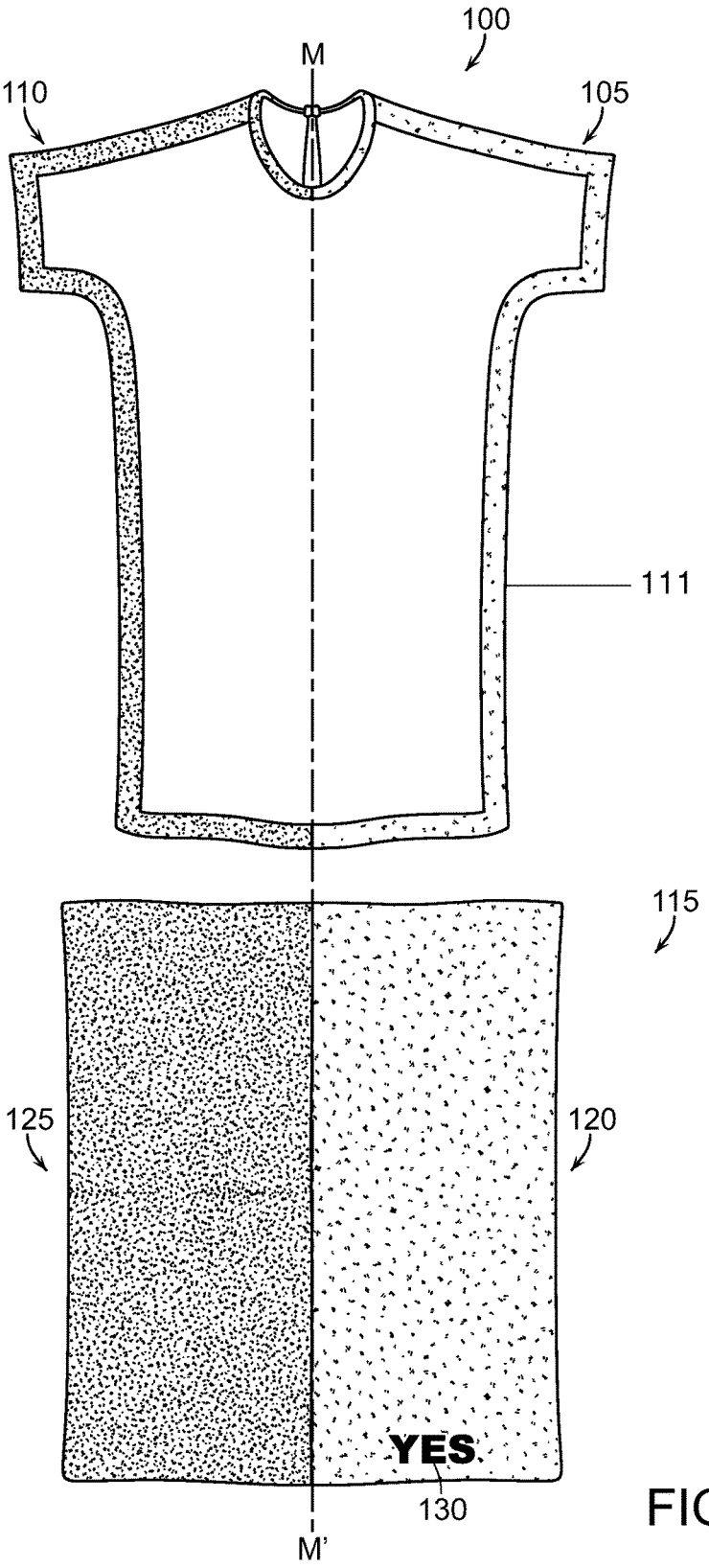
FIG. 2A is a front view of a color coded garment and bedding for a supine left side medical procedure.

In FIG. 2A, the opposite color identification schema (as opposed to FIG. 1A) is laid out. The garment 100 has the first color 105 identifying a site subject to a medical procedure on the left side (medical patient facing outwards) with the second color 110 identifying a neutral site on the right side of the garment 100, the color scheme being divided down the midline (M) of the garment 100.

The bed covering 115 bears the same color scheme as the garment 100 with the first color 120 and visual indicia 130 on the left side (if the medical patient were laying in supine position on bed covering 115) and the second color 125 on the right side of the bed covering 115. The bed covering 115 being divided into the two colors down the midline (M').

Figure 2B:
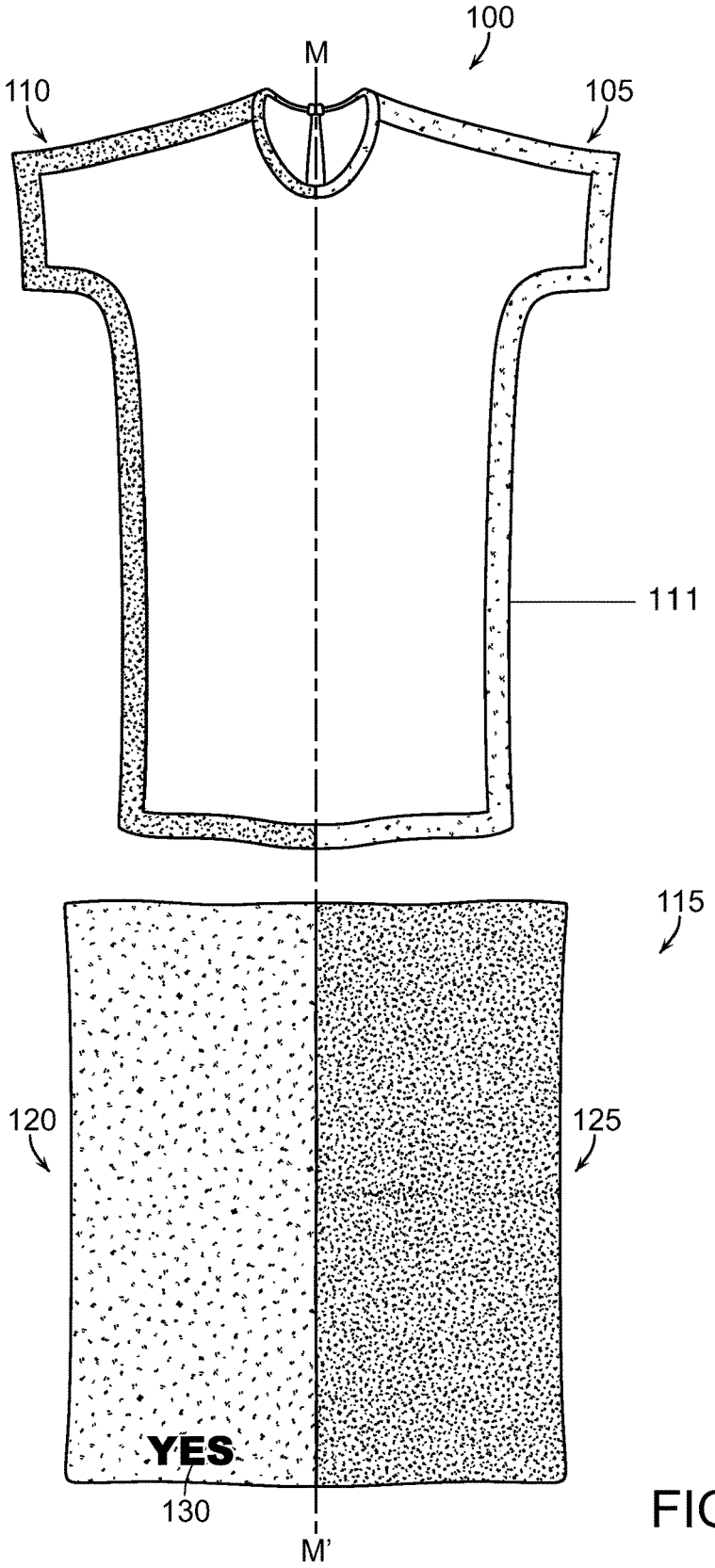
FIG. 2B is a front view of a color coded garment and bedding for a prone left side medical procedure.

Referring now to FIG. 2B, the garment 100 has a first color 105 identifying a medical procedure site on one side of the medical patient's body and the second color 110 identifying a neutral site on the other side of the garment. When the medical patient, in this case, is positioned in a prone position, the first color 105 of the garment 100 will overlay the first color 120 of the bed covering 115. The second color 110 of the garment 100 will overlay the second color 125 of the bed covering 115.

Further, the visual indicia 130 verifies the correct side on which the medical procedure is going to be performed by indicating "yes." Thus, the position necessitated by the medical procedure should always have the first color 105 and the second color 110 of the trim 111 of the garment 100 aligned and matching the same color of the bed covering 115. This ensures that the correct body position and correct body side will be subjected to a medical procedure.

Figure 3:
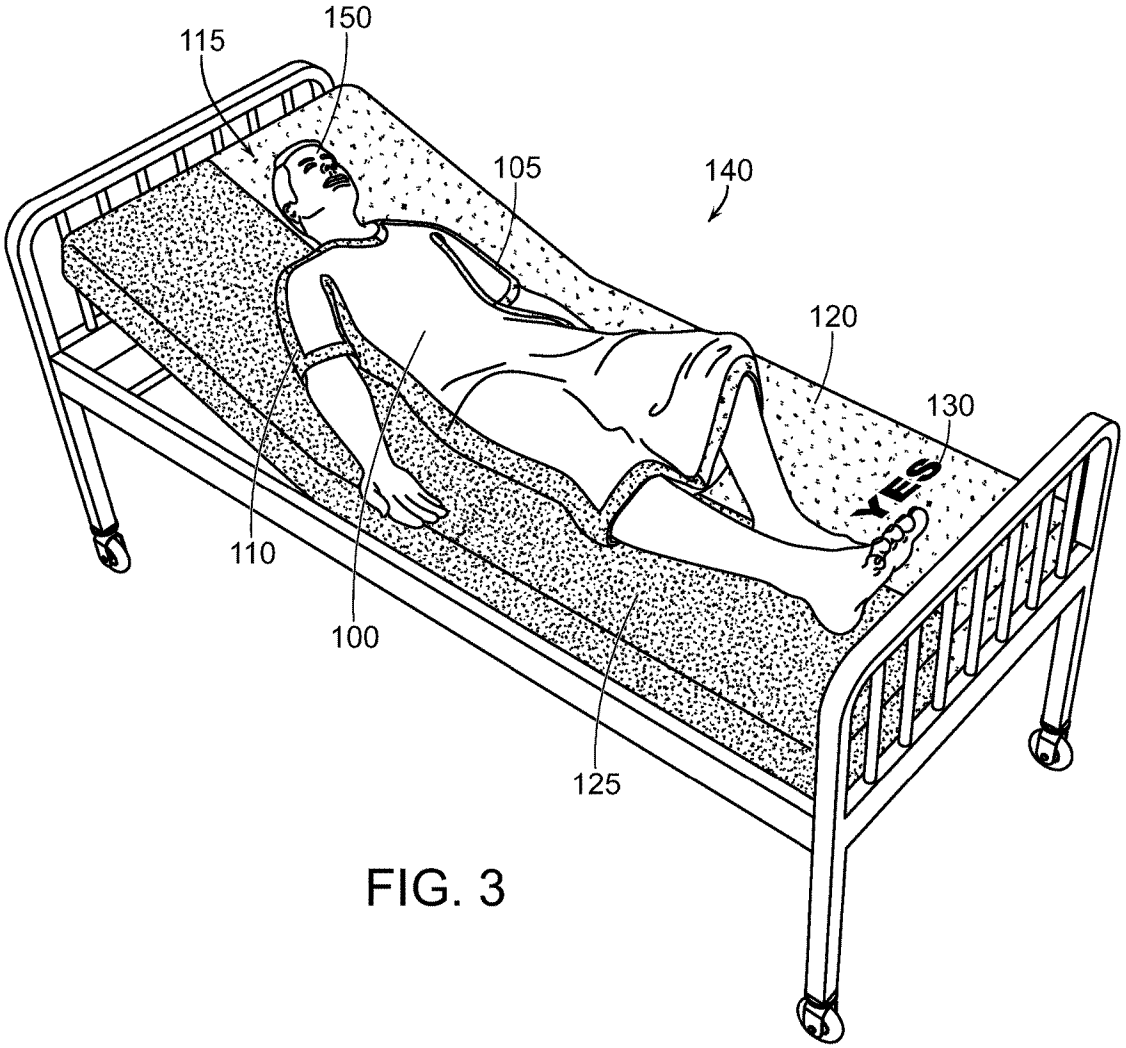
FIG. 3 is a perspective view of a medical patient on a bed with the medical patient wearing a supine left side medical procedure garment and the bed having the correct bedding or fabric covering placed thereon.

The principles exemplified in FIGS. 1A-2B are clearly illustrated in FIG. 3. Referring now to FIG. 3, there is a medical patient 150 positioned on a bed 140. The medical patient 150 has a garment 100 as described above in FIGS. 1A-2B. The garment 100 has a trim 111 with a first color 105 and a second color 110. The first color 105 identifies the side of the medical patient's body that is subject to a medical procedure, whereas the second color 110 identifies the side of the body that is a neutral site.

The medical patient 150 is laying in a supine position over a bed covering or bedding 115 in accordance with an embodiment of the present invention. The bed covering 115 has a first color 120 and a second color 125. The first color 120 of the bed covering 115 matches the first color 105 of the garment 100. The second color 125 of the bed covering 115 matches the second color 110 of the garment 100. Thus, it is clear that the medical patient 150 is subject to a medical procedure to occur on the left side of their body. This is reinforced by the visual indicia 130 present on the bed covering 115. The "yes" marking verifies that this is the correct side. If the medical patient 150 is having a hand operation, given both the color scheme of the garment 100 and the bed covering 115 the staff can be assured the hand operation is to occur on the left hand rather than the right hand.

Figure 4:
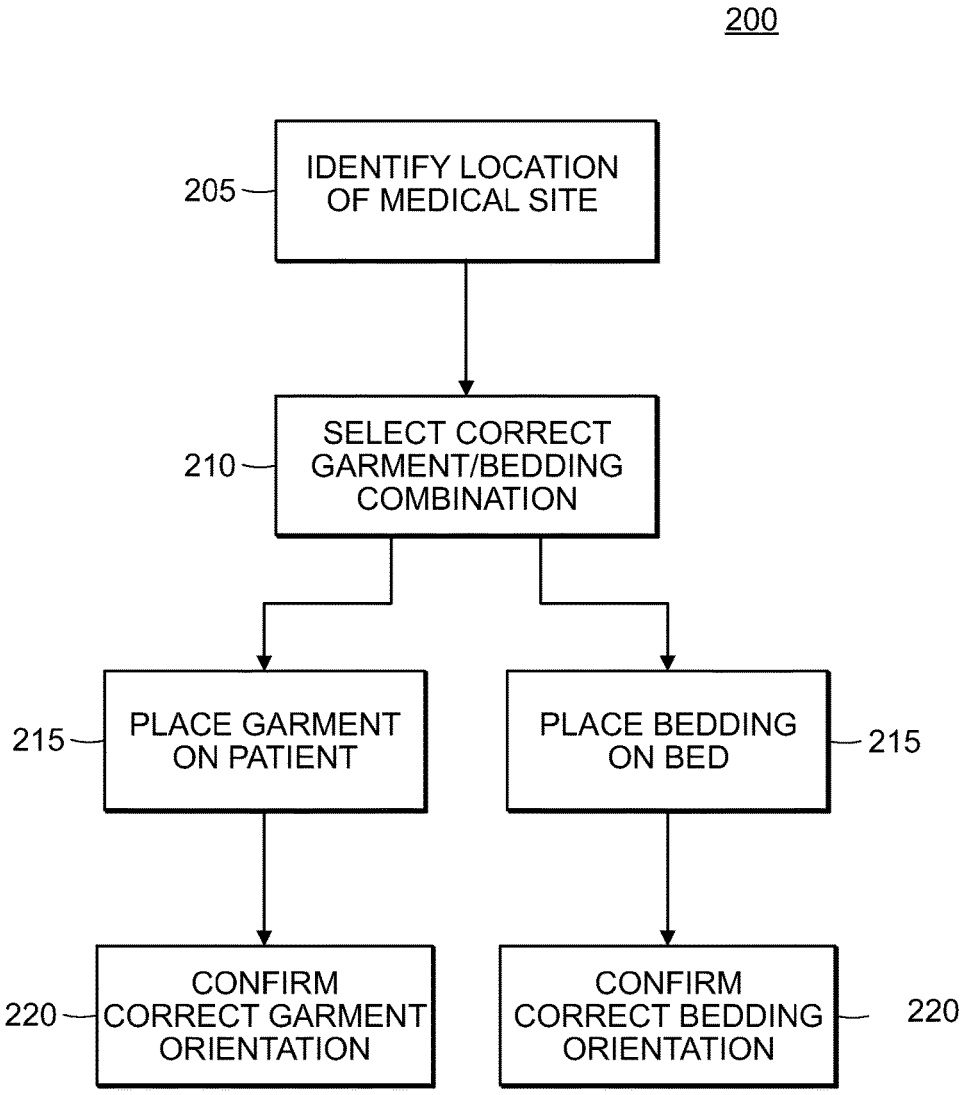
FIG. 4 is a flowchart illustrating an overview of a method of employing the present invention.

Referring to FIG. 4, there is a flowchart illustrating a method 200 of verifying that the correct garment 100 and bed covering 115, as shown in FIG. 3, is used to correctly identify a site of a medical procedure to take place on a medical patient's body.

Generally speaking, a medical patient, when arriving at a medical facility such as a hospital or surgical center, the medical patient must first check in. This verifies the medical patient is at the facility and the facility can begin the prepping phase. Typically a nurse or practitioner will come out after some time and greet the patient and take them to begin the pre-procedure prepping process.

In a step 205, the nurse or practitioner identifies (verifies) the side of the medical patient's body for the medical procedure to take place. The nurse or practitioner may ask the patient which side of the body is the medical procedure to be performed and compare the medical patient's response with their medical records.

In a step 210, the correct garment and bedding combination is selected. The nurse or practitioner may provide the medical patient with a variety of prepackaged garment and bedding combinations asking the medical patient to select the correct garment/bedding combination.

There may be numerous combinations of garments/bedding but exemplary combinations should be right side medical procedure, left side medical procedure, right side prone medical procedure, and left side prone medical procedure or any combination thereof. The nurse or practitioner may also have to inform the medical patient whether they will be placed in a supine or prone position. The medical patient should then select a garment/bedding combination package and verify with the nurse or practitioner the correct combination has been selected.

In step 215, the medical patient puts on the garment and the nurse or practitioner places the bedding on the bed. Further, the placement of the garment and the bedding may be performed wholly or in part by either the medical patient or nurse or practitioner.

In a step 220, once the patient has the garment on, both the medical patient and the nurse or practitioner verify the garment is on in the correct orientation and the correct garment has been selected. The nurse or practitioner can then verify and sign off on the verification of the proper garment selection. The medical patient can then do the same. The nurse or practitioner can then have the patient lie down in the correct position on the bed.

The nurse or practitioner can observe, as well as the medical patient, whether the color scheme of the garment and the bedding align with one another. It should be visually apparent that the colors on each side of the midline of the garment and the bedding align and match one another. If this is not the case, the method 200 should be restarted to ensure accuracy. Once the medical procedure is to begin, the staff will still perform any and all other protocol including "time out" procedures to further ensure the medical patient's identity, the medical procedure to be performed, and the nature of the medical procedure.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A method of identifying a medical procedure site, the method having the steps of:

identifying a location of at least one medical procedure site on a medical patient;

selecting a color coded garment and a color coded bedding combination, wherein the color coded garment and the color coded bedding have a color scheme that identifies the location of the at least one medical procedure site; and placing the color coded garment on the medical patient in the correct orientation and the color coded bedding on a bed in the correct orientation.

2. The method of claim 1 further comprising the step of:

confirming the correct orientation of the color coded garment and the color coded bedding.

3. The method of claim 2 wherein the orientation of the color coded garment is confirmed by establishing the coloration pattern of the color coded garment aligns with the correct location of a medical procedure site.

4. The method of claim 2 wherein the orientation of the color coded bedding is confirmed by establishing the coloration pattern of the color coded bedding aligns with the correct location of a medical procedure site.

5. The method of claim 4 wherein the orientation of the color coded bedding is confirmed by establishing the correct orientation and/or location of the visual indicia.

* * * * *